United States Patent [19]

Sanders et al.

[11] Patent Number: 4,823,049

[45] Date of Patent: Apr. 18, 1989

[54] VEHICLE LAMP HAVING A MOLDED LAMP CAP WITH INTEGRAL CURRENT-SUPPLY CONDUCTORS AND DIPPING CAP

[75] Inventors: Rudolf Sanders; Josephus F. Rijckaert, both of Eindhoven, Netherlands

[73] Assignee: U.S. Philips Corporation, New York, N.Y.

[21] Appl. No.: 233,938

[22] Filed: Aug. 15, 1988

Related U.S. Application Data

[63] Continuation of Ser. No. 932,955, Nov. 19, 1986, abandoned.

[30] Foreign Application Priority Data

Nov. 19, 1985 [NL] Netherlands ..... 8503181
Jan. 31, 1986 [NL] Netherlands ..... 8600226

[51] Int. Cl.[4] ..... H01J 61/30
[52] U.S. Cl. ..... 313/623; 313/318
[58] Field of Search ..... 313/318, 634, 580, 623, 313/624, 625

[56] References Cited

U.S. PATENT DOCUMENTS 4,594,529 6/1986 de Vrijer ..... 313/634 X
4,626,734 12/1986 Greiler ..... 313/318 X

*Primary Examiner*—David K. Moore
*Assistant Examiner*—Sandra L. O'Shea
*Attorney, Agent, or Firm*—Brian J. Wieghaus

[57] ABSTRACT

The capped vehicle headlight lamp has a solid lamp cap with integral current supply conductors. The first ends of the current-supply conductors form lamp contacts. The current-supply conductors extend parallel to the lamp cap center line and have portions at right angles to the center line and at right angles to each other. The lamp vessel has current lead-through conductors, which are arranged diametrically opposite to each other and extend at least substantially along the center line of the lamp cap. The lamp may comprise a dipping cap, which is connected without a seam to the lamp cap and in whose wall a current supply conductor is included. The invention renders it possible to firmly secure the lamp vessel and the lamp cap to each other in an aligned position, while the construction of the lamp is nevertheless simple and reliable. Furthermore, a conductor not conveying current can be included in the dipping cap. This conductor and the current supply conductors may have a rectangular cross-section in order to obtain a larger thermal contact with the dipping cap.

22 Claims, 2 Drawing Sheets

VEHICLE LAMP HAVING A MOLDED LAMP CAP WITH INTEGRAL CURRENT-SUPPLY CONDUCTORS AND DIPPING CAP

This is a continuation of application Ser. No. 932,955, filed 11/19/86, abandoned.

BACKGROUND OF THE INVENTION

The invention relates to a capped vehicle headlight lamp provided with a translucent lamp vessel which is sealed in a vacuum-tight manner, which is filled with an ionizable gas and in which a pair of electrodes is arranged. Current lead-through conductors extend through the wall of the lamp vessel to the pair of electrodes. The lamp cap is comprised mainly of electrically insulating material and is firmly connected to the lamp vessel. Current supply conductors have first ends connected to contacts at the lamp cap and second ends secured to a respective lead-through conductor.

Such an electrical discharge lamp is known from European Patent Application No. 0 152 649 corresponding to U.S. Ser. No. 685,709, now U.S. Pat. No. 4,634,920 use for the lamp according to the invention requires that the lamp vessel be firmly connected to the lamp cap because of shocks and vibrations to which the lamp will be subjected. The pair of electrodes must have an accurately defined position with respect to a reference point at the lamp cap in order that the discharge path between the pair of electrodes will occupy the correct position with respect to the focus of the reflector of a headlight lantern in which the lamp is arranged.

In the known lamp, these requirements are satisfied for the major part. One end of the lamp vessel is arranged with clamping fit in a metal plate having a cylindrically flanged edge. The lamp cap has a cavity in which a metal sleeve is fixed, which cooperates telescopically with the said metal plate and is secured to it after the lamp vessel has been set to the correct position. In this lamp, the use of cement is avoided. This is important because cement can absorb moisture, which may lead to corrosion of a reflector, and because cement can become brittle and can crumble off under the influence of varying thermal and mechanical loads.

Nevertheless, the known lamp has a number of disadvantages. The lamp has a large number of components, which have to be joined and secured to each other. Furthermore, in an electrical discharge lamp used as a vehicle headlight lamp in contrast to an electrical incandenscent lamp for this application, the dimensions of the end of the lamp vessel are sometimes so small that it is very difficult to ensure that the metal plate firmly holds the lamp vessel. This is the case especially if the lamp vessel has two oppositely arranged ends, where a respective current lead-through conductor is passed through the wall of the lamp vessel.

Another disadvantage is that the lamp has to burn during its alignment when it is secured to the lamp cap. Due to the above mentioned disadvantages, the operation of securing the lamp vessel to the lamp cap is difficult, time-consuming and hence expensive.

British Patent Application No. 2,132,011 corresponding to U.S. Pat. No. 4,594,529 discloses a capped electrical discharge lamp for use as a vehicle headlight lamp, in which a dripping cap extends along the lamp vessel, which during operation of the lamp intercepts a part of the emitted light in order to assist in forming a dipped light beam. In such a lamp, not only the lamp cap and the lamp vessel, but the lamp cap, the lamp vessel and the dipping cap have to be aligned with respect to each other, which makes the manufacture of the lamp even more complicated.

In the above British Patent Application, the lamp cap and the means for securing the lamp vessel thereto are indicated only diagrammatically. It is not clear how it is achieved that the lamp vessel, the lamp cap and the dipping cap are aligned with respect to each other.

SUMMARY OF THE INVENTION

The invention has for its object to provide a lamp of the kind described in the opening paragraph, which has a simple and reliable construction which can be readily manufactured.

According to the invention, this object is achieved in that the lamp cap is at least substantially a solid moulding which secures the current-supply conductors and which encloses the current-supply conductors circumferentially over part of their length. Second ends of the current supply conductors are located outside the lamp cap and extend transversally to the center line of the lamp cap and transversally to each other.

The current lead-through conductors pass through the wall of the lamp vessel at diametrically opposite areas and extend at least substantially along the center line of the lamp cap.

An embodiment of the lamp according to the invention is characterized in that a dipping cap partly surrounding the lamp vessel extends along the lamp vessel and the dipping cap is integral with the lamp cap.

Another embodiment of the lamp according to the invention is characterized in that a dipping cap partly surrounding the lamp vessel extends along the lamp vessel and a current supply conductor is included in the wall of the dipping cap.

An embodiment, which is particularly, study and can nevertheless be manufactured in a simple manner, has the feature of each of the two preceding embodiments.

If the lamp vessel of the lamp according to the invention is provided with a lamp cap, only two components need be joined, i.e. the finished lamp vessel and the finished lamp cap. This is in strongly marked contrast with the lamp known from the aforementioned European Patent Application corresponding to U.S. patent application Ser. No. 685,709. Moreover, the lamp cap itself has a particularly small number of components. In a favourable embodiment, in which the current supply conductors are integral with the contacts of the lamp cap, this number of components is even smaller. In a favourable variation, tongue-shaped contacts are formed at wire-shaped current supply conductors by flattening them.

Due to the fact that the dipping cap, if present, extends along the lamp vessel and partly surrounds this lamp vessel, during operation of the lamp this dipping cap is thermally heavily loaded. Areas located close to the discharge arc are more heavily loaded than farther remote areas. An advantage of a lamp in which a current supply conductor is included in the wall of the dipping cap and passes through this dipping cap at least substantially entirely, is that this current supply conductor equalizes the temperature distribution over the dipping cap. This temperature distribution is even more uniform if an additional conductor not conveying current is included in the wall of the dipping cap and passes through the dipping cap at least for the major part. This conductor may be positioned symmetrically to the said current supply conductor in the wall of the dipping cap.

Since a conductor of circular cross-section has a smaller surface per unit length than a conductor of rectanglar cross-section having the same surface dimension, it is advantageous to choose for the conductor not conveying current and for the current supply conductor a flat form, i.e. a rectangular cross-section. The conductors are then in thermal contact with the dripping cap over a larger surface area and can distribute the heat more uniformly. This is of importance because it may be desirable that the surface of the dimout cap facing the discharge lamp reflects little radiation, for example due to the fact that it is frosted or blackened.

The conductor not conveying current may be integral with one of the current supply conductors. This conductor is then an extension of the current supply conductors but does not convey current.

The use of conductors of rectangular cross-section has the advantage that they can be obtained from a strip of sheet metal. They can be stamped out of this strip in the correct shape and in the correct relative position. They can be held by the longitudinal side of the strip and inserted into to a mould in which the lamp cap is formed. The cycle time of the process in the mould can thus be considerably shortened.

The current conductor which is passed through the dipping cap and/or the conductor not conveying current may have a vane or several vanes that extend in to the bottom part of the dipping cap. Such vane(s) help to distribute heat more evenly over the dipping cap.

With the use of current supply conductors of rectangular cross-section, it has proved to be favourable that their second ends have a rib extending transverse to the center line of the lamp cap. This rib then forms a pointed contact with a current supply conductor, as a result of which a welding connection can be readily established between these two parts.

When the lamp cap of the lamp according to the invention is mounted, only two connections need be established, which each have an electrical as well as a mechanical function, i.e. to secure the current lead-through conductors to a respective current supply conductor. The lamp cap and the lamp vessel are both present in a jig, which holds the lamp cap and the part of the lamp vessel emitting light during operation in the correct relative position.

The lamp cap can be obtained in a simple manner in that the current supply conductors, after being mechanically aligned, are enclosed in a mould circumferentially, over part of their length in insulating material. The second ends of the current supply conductors then become positioned with a small tolerance with respect to a reference area at the lamp cap. The directions, substantially at right angles to each other, in which the second ends of the current supply conductors extend permit contacting each of these second ends with a respective current lead-through conductor and of securing these ends thereto. During this securing step, the light-emitting part of the lamp vessel retains its correct distance from this reference area at the lamp cap and the current lead-through conductors extend at least substantially along the center line of the lamp cap.

In embodiments, in which the lamp according to the invention has a dipping cap, this dipping cap may be formed in the mould from insulating material, for example so as to be integral with the lamp cap and connected to the lamp cap without a seam. Alternatively, the said dipping cap may be formed in the mould so that the dipping cap is a separate body which is connected to the lamp cap by a current supply conductor included therein. In both cases, a lamp cap is obtained, in which the dipping cap is accurately positioned with respect to a reference area at the lamp cap. In these cases, when the lamp cap is secured to the lamp vessel, the dipping cap and the lamp vessel may be included in a jig in order to attain the correct position of the lamp vessel with respect to the reference area at the lamp cap. Also in these cases, it is possible for the lamp cap with its reference area and the lamp vessel to be included in the jig when the lamp cap is secured to the lamp vessel.

In a favourable embodiment, a separation wall is present between the contacts at the lamp cap. This wall enlarges the creepage path between the contacts and may serve at the same time as a guide for providing a plug with output terminals of a supply source.

It is favourable if the lamp cap is asymmetrical in the region of its contacts so that a plug with output terminals of a supply source can be connected to the contacts only in one position, or a plug intended to supply current to a lamp without a dipping cap (for forming, for example, a main beam) cannot be connected to a lamp provided with a dipping cap for forming a dipped beam. For this purpose, a separation wall between the contacts may also be used if this wall is arranged eccentrically or is formed asymmetrically. Thus, it may also be achieved that the current supply conductors, whose second end is farthest remote from the lamp cap, is connected to the connection terminal of the zero conductor of the supply source and the other current supply conductor is connected to the voltage-conveying connection terminal. The risk that with a lamp not yet mounted in a reflector metal parts which are at a high voltage can be touched can thus be reduced.

In a particular embodiment, the contacts at the lamp cap extend at right angles to the center line of the lamp cap. This embodiment has the advantage that little room is needed behind the lamp in the vehicle, while nevertheless the plug can be readily provided. In a particularly suitable lamp, the contacts are situated on one side and the dipping cap is situated on the other side of the center line.

In another embodiment, one of the current-supply conductors has a portion which is bent back on itself. This portion can be U-shaped and transverse to the lamp axis. In embodiments having a dipping cap, the U-shaped portion is present between the dipping cap and the end of the current supply conductor remote from the lamp cap.

The material used for the lamp cap may be, for example, glass filled with mica or ceramic material filled with quartz powder, such as steatite, or a synthetic material capable of withstanding high temperatures that may be filled, such as polyimide or polyphenylene sulphide.

Embodiments of the lamp according to the invention are shown in the drawing. In the drawing.

Figure 1:
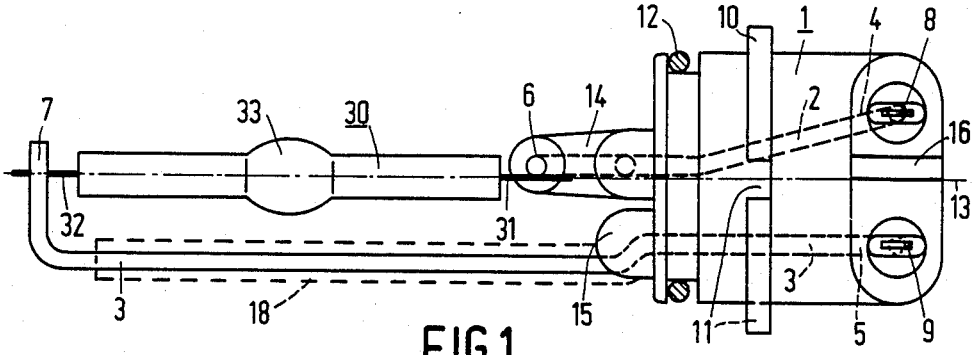
FIG. 1 shows in plan view a first embodiment.

In FIG. 1, the lamp as a lamp cap 1 mainly of insulating material, which comprises current supply conductors 2,3 each having a first end 4 and 5, respectively, and a second end 6 and 7, respectively. The first ends 4,5 are connected to a respective contact 8,9 at the lamp cap 1. The lamp cap 1 has a collar 10 which abuts against the neck of the reflector of a lantern and reference areas 11 into which a respective projection at that reflector neck must fall. Furthermore, a rubber ring 12 is provided, which seals the space between the lamp cap 1 and a reflector neck. The lamp cap 1 has a center line 13.

The lamp has a translucent lamp vessel 30, which is sealed in a vacuum-tight manner, which is filled with an ionizable gas and in which a pair of electrodes is arranged. Current lead-through conductors 31,32 extend through the wall of the lamp vessel 30 to the pair of electrodes arranged therein. The lamp vessel 30 has a portion 33 emitting light during operation and lamp vessel 30 is firmly connected to the lamp cap 1. The current lead-through conductors 31, 32 are each electrically connected to a second end 6 and 7, respectively, of a respective current supply conductor.

The lamp cap 1 is a substantially solid moulding enclosing the current supply conductors 2,3 immovably, circumferentially over part of their length. The second ends 6,7 of the current supply conductors 2,3 are located outside the lamp cap 1 and extend transversally to the center line 13 of the lamp cap 1 and transversally to each other.

Due to protuberance 14, 15 at the lamp cap 1, from which emanate the current supply conductors 2,3, a large creepage path exists between bare parts of the current supply conductors 2,3.

The current lead-through conductors 31,32 emanate from the lamp vessel diametrically opposite to each other and extend at least substantially along the center line 13 of the lamp cap 1. By locally flattening the current supply conductors 2,3, contacts 8,9 at the lamp cap 1 are formed at these conductors, which contacts extend at right angles to the center line 13. A separation wall 16 is located eccentrically between the contacts 8,9.

It may be useful if the protuberance 15 extends further as an envelope 18 around the current supply conductor 3. If the lamp vessel 30 contains sodium salts as an ionizable gas constituent, the envelope 18 prevents sodium from being extracted from the discharge vessel due to photo emission. The light beam is enhanced if the long current supply conductor 3 is situated in the lantern below the lamp vessel 30. FIG. 1 shows the lamp in side elevation.

Figure 2:
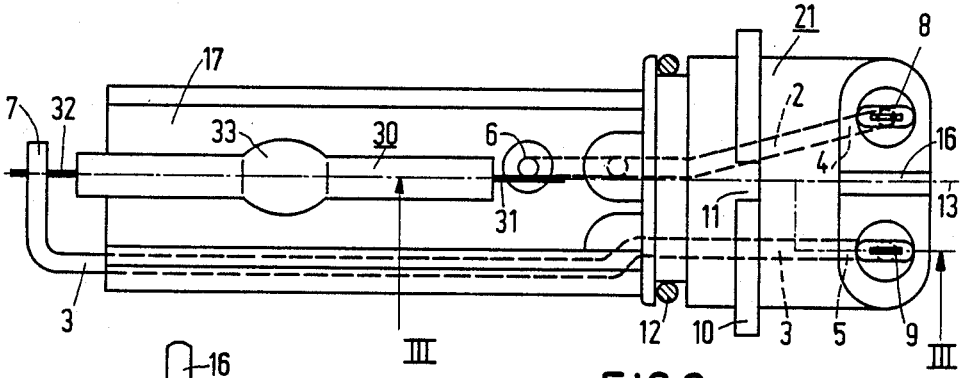
FIG. 2 shows in plan view a second embodiment.
Figure 4:
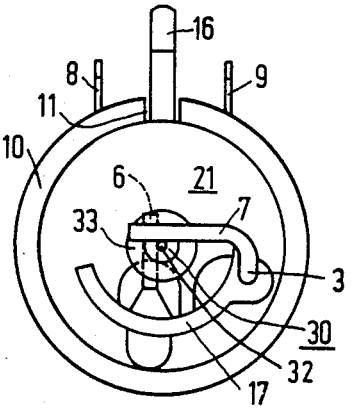
FIG. 4 shows in front elevation the embodiment of FIG. 2.
Figure 3:
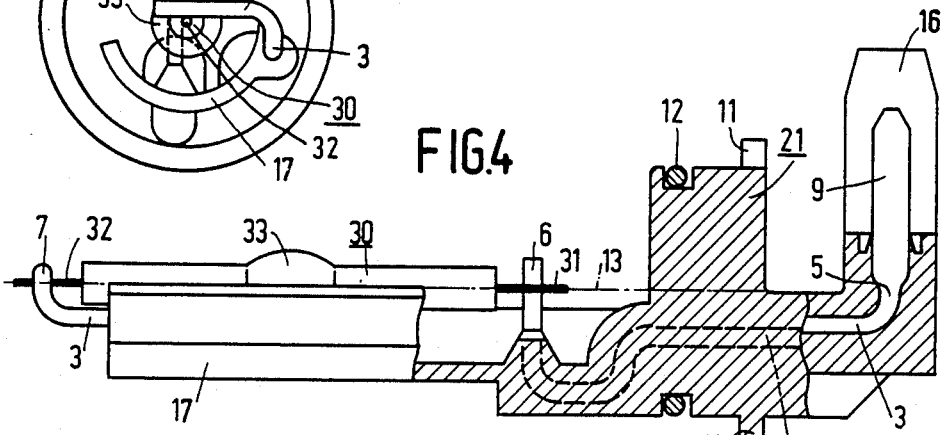
FIG. 3 shows the embodiment of FIG. 2 partly in side elevation and partly in sectional view taken on the line III—III in FIG. 2.

In FIGS. 2, 3 and 4, the reference numerals corresponding to those in FIG. 1 have the same meaning. The lamp has a dipping cap 17 which is integral with the lamp cap 21. The wall of this dipping cap 17 includes the current conductor 3, which passes through the dipping cap 17.

Since during operation the dipping cap 17 is situated below the lamp vessel 30, the contacts 8,9 in the embodiment shown (FIGS. 2,3,4) extend upwards on the side of the center line 13 opposite to that on which extends the dipping cap 17. The dipping cap 17 extends along the lamp vessel 30 and surrounds it through about 165°.

During the process of assembling the lamp cap 21 and the lamp vessel 30, the lamp cap 21 with its dipping cap 17 and the lamp vessel 30 with its part 33 emitting light during operation were arranged in a jig. In the inoperative condition of the lamp, the current lead-through conductors 31,32 were contacted with and welded to a respective second ends 6,7 of the current supply conductors 2,3. Due to the fact that the second ends 6,7 extend substantially at right angles to each other at a small distance from the centre line 13, these welding connections can be established while maintaining the correct position of the light-emitting part 33 of the lamp vessel 30 with respect to the reference area 11 in spite of inaccuracies in the positions of the conductors 6,7 and lead-through conductors 31,32.

An example of a lamp vessel is a quartz glass lamp vessel comprising diametrically oppositely arranged electrodes, which project into the lamp vessel over a distance of 1 mm and have a relative distance of 4.5 mm, the lamp vessel having a wall thickness of 1.75 mm. The diameter of the discharge space halfway between the electrodes, where the discharge space is cylindrical, is 2.5 mm. Laterally of the electrodes, the discharge space tapers conically. A narrow lamp vessel having an inner diameter of at most a few millimetres is necessary in order that a substantially straight discharge arc can be obtained in spite of the horizontal position of the lamp in a vehicle headlight lantern and in order that the light generated can be adequately concentrated.

The lamp vessel is filled with 53.5 kPa of argon, 1.4 mg of mercury and 1 mg of a mixture of sodium-iodide, scandium-iodide and thorium-iodide in a molar ratio of 94.5:4.4:1.1. During operation at 100 V, 100 kHz, the lamp consumes a power of 35W.

The lamp shown in FIGS. 1–6 are intended to be used, in a car as a headlight lamp. The lamp shown in FIG. 1 provides high-beam light while the lamp of FIGS. 2–6 provide low beams. When arranged in a lantern, the light-emitting part 33 of the lamp vessel is found to be located within the intended region of the lantern. However, the lamp of FIG. 1 may alternatively be used as a fog-lamp.

Figure 5:
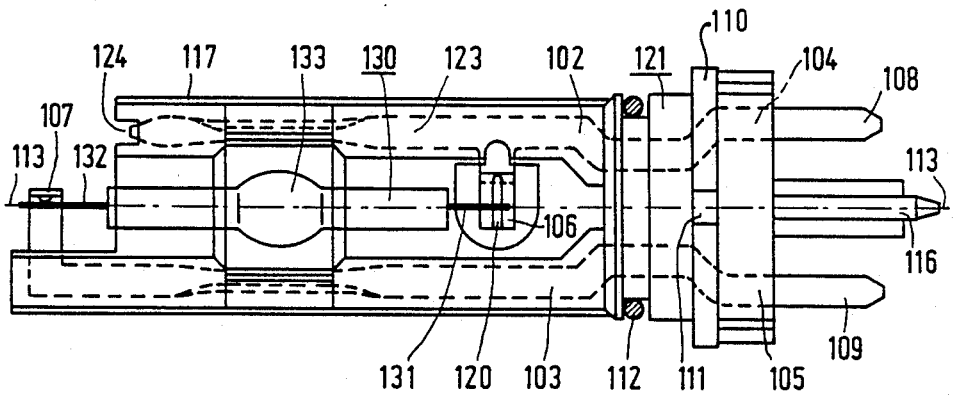
FIG. 5 shows in plan view a third embodiment.
Figure 6:
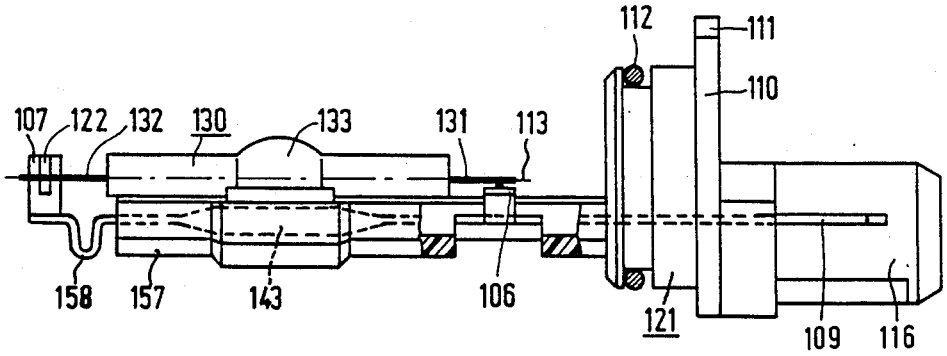
FIG. 6 shows the embodiment of FIG. 5 in side elevation, partly broken away.

In FIGS. 5 and 6, parts corresponding to parts in FIG. 2 are designated by a reference numeral which is 100 higher.

The current supply conductors 102 and 103 have a rectangular cross-section and hence a large surface area. The current supply conductor 103 is included in the wall of the dipping cap 117 and extends inside it for the major part. A heat conductor 123 not conveying current, having a rectangular cross-section is also included in the dipping cap 117. The conductor 123 not conveying current is electrically connected to (is integral with) the current supply conductor 102 to facilitate, the manufacuture of the lamp cap 121. The second ends 106 and 107 of the current supply conductors 102 and 103, respectively, have a rib 120 and 122, respectively, on which the welding connection with the current supply conductors 131 and 132, respectively, is established.

The free end of the conductor 123 is hidden in a cavity 124.

One current supply conductor 143 extends through the dipping cap 157 and has an end 107 connected to the lead-through 132. Between the end 107 and the dipping cap, current supply conductor 143 has a portion which is bent back on itself. This portion 158 may be U-shaped. The dipping cap 157 is shorter than a the dipping cap 117 of FIG. 5 to provide space for the bent portion 158.

What is claimed is:

1. A vehicle lamp, comprising:

(a) a discharge device having a longitudinal axis and opposing ends, said discharge device having first and second lead-throughs each extending from a respective end along said longitudinal axis;

(b) a one-piece insulative lamp base comprising a solid molding having a first face facing said discharge device, said first lead-through extending towards said first face and said second lead-through extending away from said first face; and (c) first and second current-supply conductors each having a portion molded in said lamp base securing said current-supply conductors in said lamp base, each said current-supply conductor extending away from said first face towards said discharge device, each current-supply conductor being connected to a respective lead-through for energizing said discharge device and supporting said discharge device with respect to said lamp base; and (d) each current-supply conductor having a portion defining lamp contacts extending from a portion of said lamp base other than said first face.

2. A lamp as claimed in claim 1, wherein said lamp has a molded insulative dipping cap aligned with and facing said discharge device for intercepting a portion of emitted light from said discharge device, and said second current-supply conductor comprises a first portion molded integrally in said dipping cap to secure said dipping cap with respect to said discharge device.

3. A lamp as claimed in claim 2, wherein said first portion has a rectangular cross-section for removing heat and equalizing the temperature in said dipping cap.

4. A lamp as claimed in claim 2, wherein said first portion further comprises vanes extending within said dipping cap for removing heat and equalizing the temperature in said dipping cap.

5. A lamp as claimed in claim 1, wherein said first current-supply conductor has a portion molded integrally within said dipping cap having a leg protruding from said dipping cap connected to said first lead-through, said first current-supply conductor portion having an elongate vane extending within said dipping cap for removing heat and equalizing the temperature in said dipping cap.

6. A lamp as claimed in claim 1, wherein said second current-supply conductor is enclosed by insulating material over substantially its entire length.

7. A vehicle headlamp, comprising:

(a) a discharge device having a longitudinal axis and opposing ends, said discharge device having first and second lead-throughs each extending from a respective end along said longitudinal axis; and (b) a one-piece insulative lamp base having a reference point and a first face facing said discharge device, said first lead-through extending towards said first face and said second lead-through extending away from said first face;

(c) an elongate molded dipping cap integral with said lamp base and aligned with said reference point extending from said lamp base aligned with and facing said discharge device for intercepting a portion of emitted light from said discharge device;

(d) first and second rigid current-supply conductors, each said current-supply conductor having a portion molded integrally in said lamp cap securing said current-supply conductors in said lamp cap, each said current-supply conductor extending from said lamp cap towards said discharge device, said first current-supply conductor having a portion connected to said first lead-through, said second current-supply conductor having a first portion molded in said dipping cap extending substantially throughout the entire length of said dipping cap and a second portion connected to said second lead-through, said discharge device being supported by said lead-throughs, and (e) each current-supply conductor having a portion defining lamp contacts emerging from a portion of said lamp cap other than said first face, whereby said lamp may be assembled by aligning said discharge device with said reference point and connecting said discharge device to said current-supply conductors which are integral with said lamp base.

8. A lamp as claimed in claim 7, wherein said first portion of said second current supply conductor has a rectangular cross-section for removing heat from said dipping cap and equalizing the temperature distribution in said dipping cap.

9. A lamp as claimed in claim 8, wherein said first portion further comprises non-current-carrying heat conductive vanes integral with said current-supply conductor.

10. A lamp as claimed in claim 7, wherein said first current-supply conductor comprises a portion molded in said dipping cap having a current-carrying leg protruding from said dipping cap connected to said first lead-through and a heat conductive vane for equalizing the temperature distribution in said dipping cap.

11. A lamp as claimed in claim 8, wherein a said current-supply conductor has a portion having a rectangular cross-section connected to a respective said lead-through by a weld and comprises a rib extending transverse to said respective lead-through forming a pointed contact whereby welding of said welded connection is facilitated.

12. A lamp as claimed in claim 9, wherein a said current-supply conductor has a portion having a rectangular cross-section connected to a respective said lead-through by a weld, said portion comprising a rib extending transverse to said respective lead-through forming a pointed contact whereby welding of said welded connection is facilitated.

13. A lamp cap as claimed in claim 10, wherein a said current-supply conductor has a portion having a rectangular cross-section connected to a respective said lead-through by a weld, said portion comprising a rib extending transverse to said respective lead-through forming a pointed contact whereby welding of said welded connection is facilitated.

14. A lamp as claimed in claim 7, wherein said second current-supply conductor comprises a curved portion having the current-supply conductor substantially bent back on itself between said transverse portion and said dipping cap for reducing stress in said second current-supply conductor resulting from differing expansions between said lamp cap and said discharge vessel.

15. A lamp as claimed in claim 4, wherein said curved portion of said second current-supply conductor is U-shaped.

16. A lamp as claimed in claim 7, wherein said lamp contacts comprise tongue-shaped flattened portions extending from said lamp cap parallel to each other and transverse to said longitudinal axis.

17. A lamp as claimed in claim 16, wherein said concave face of said dipping cap faces in a direction transverse to said longitudinal axis of said lamp cap and said tongue-shaped lamp contacts extend in said transverse direction.

18. A lamp as claimed in claim 17, wherein said lamp further comprises a wall portion extending between said lamp contacts for enlarging the leakage path between said lamp contacts.

19. A lamp as claimed in claim 15, wherein said lamp further comprises a wall portion extending between said lamp contacts for enlarging the leakage path between said lamp contacts.

20. A lamp as claimed in claim 13, wherein said lamp further comprises a wall portion extending between said lamp contacts for enlarging the leakage path between said lamp contacts.

21. A lamp as claimed in claim 18, wherein said wall portion is asymmetric with said longitudinal axis so that an external plug for supplying lamp operating current can be connected in only one orientation.

22. A lamp as claimed in claim 21, wherein said lamp cap further comprises a shoulder for positioning the lamp with respect to an external reflector.

* * * * *